US010669618B2

(12) United States Patent
Curran et al.

(10) Patent No.: US 10,669,618 B2
(45) Date of Patent: Jun. 2, 2020

(54) DURABLE COSMETIC FINISHES FOR TITANIUM SURFACES

(71) Applicant: Apple Inc., Cupertino, CA (US)

(72) Inventors: James A. Curran, Morgan Hill, CA (US); Zechariah D. Feinberg, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/182,473

(22) Filed: Nov. 6, 2018

(65) Prior Publication Data

US 2019/0078192 A1 Mar. 14, 2019

Related U.S. Application Data

(62) Division of application No. 14/965,716, filed on Dec. 10, 2015, now Pat. No. 10,151,021.

(60) Provisional application No. 62/234,946, filed on Sep. 30, 2015.

(51) Int. Cl.

| | |
|---|---|
| ***C23C 8/20*** | (2006.01) |
| ***C23C 8/80*** | (2006.01) |
| ***C23C 8/08*** | (2006.01) |
| ***C23C 8/24*** | (2006.01) |
| ***C23C 8/28*** | (2006.01) |
| ***C23C 8/30*** | (2006.01) |
| ***C25D 11/02*** | (2006.01) |
| ***C25D 11/26*** | (2006.01) |

(52) U.S. Cl.

CPC ..... *C23C 8/20* (2013.01); *C23C 8/08* (2013.01); *C23C 8/24* (2013.01); *C23C 8/28* (2013.01); *C23C 8/30* (2013.01); *C23C 8/80* (2013.01); *C25D 11/026* (2013.01); *C25D 11/26* (2013.01)

(58) Field of Classification Search

CPC .... C23C 8/20; C23C 8/80; C23C 8/30; C23C 8/24; C23C 8/28

See application file for complete search history.

(56) References Cited

U.S. PATENT DOCUMENTS

| | | | |
|---|---|---|---|
| 4,507,184 | A | 3/1985 | Murata et al. |
| 5,447,803 | A | 9/1995 | Nagaoka et al. |
| 5,792,289 | A | 8/1998 | Morton et al. |
| 6,093,259 | A | 7/2000 | Watanabe et al. |
| 8,262,814 | B2 | 9/2012 | Zak |
| 2012/0241324 | A1 | 9/2012 | Chang et al. |
| 2014/0254072 | A1 | 9/2014 | Zhang |
| 2017/0088931 | A1 | 3/2017 | Curran et al. |

FOREIGN PATENT DOCUMENTS

| | | | |
|---|---|---|---|
| JP | 03079337 | A | 4/1991 |
| JP | 08176802 | A | 7/1996 |
| TW | I452176 | B | 9/2014 |

OTHER PUBLICATIONS

International Patent Application No. PCT/US2016/043663—International Search Report and Written Opinion dated Oct. 12, 2016.

Taiwanese Patent Application No. 105125816—Office Action dated Dec. 13, 2017.

Taiwanese Patent Application No. 105125816—Office Action dated Oct. 18, 2018.

*Primary Examiner* — Jessee R Roe

(74) *Attorney, Agent, or Firm* — Dorsey & Whitney LLP

(57) ABSTRACT

A method for providing a surface finish to a metal part includes both diffusion hardening a metal surface to form a diffusion-hardened layer, and oxidizing the diffusion-hardened layer to create an oxide coating thereon. The diffusion-hardened layer can be harder than an internal region of the metal part and might be ceramic, and the oxide coating can have a color that is different from the metal or ceramic, the color being unachievable only by diffusion hardening or only by oxidizing. The metal can be titanium or titanium alloy, the diffusion hardening can include carburizing or nitriding, and the oxidizing can include electrochemical oxidization. The oxide layer thickness can be controlled via the amount of voltage applied during oxidation, with the oxide coating color being a function of thickness. An enhanced hardness profile can extend to a depth of at least 20 microns below the top of the oxide coating.

20 Claims, 7 Drawing Sheets

DURABLE COSMETIC FINISHES FOR TITANIUM SURFACES

CROSS-REFERENCE TO RELATED APPLICATION

This application is a divisional of U.S. application Ser. No. 14/965,716, now U.S. Pat. No. 10,151,021, filed Dec. 10 2015, entitled "DURABLE COSMETIC FINISHES FOR TITANIUM SURFACES," which claims the benefit of U.S. Provisional Patent Application No. 62/234,946, filed on Sep. 30, 2015, entitled "DURABLE COSMETIC FINISHES FOR TITANIUM SURFACES," the contents of which are incorporated herein by reference in their entirety for all purposes.

FIELD

The described embodiments relate generally to surface finishes for materials. More particularly, the described embodiments relate to abrasion resistant cosmetic surface finishes for metal parts, such as for a consumer device housing.

BACKGROUND

Anodizing is a common method of providing an anodic oxide coating on a metal substrate, often used in industry to provide a protective and sometimes cosmetically appealing coating to metal parts. During an anodizing process, a portion of the metal substrate is converted to a metal oxide, thereby forming a protective oxide layer or coating. The nature of the anodic oxide coatings can depend on a number of factors, including chemical makeup of the metal substrates and the process parameters used in the anodizing processes. Anodizing can be a particularly useful technique to preserve surface finishes on the exterior of a consumer device, particularly with respect to soft metals that scratch or dent easily, such as aluminum.

Titanium is a relatively hard metal for which anodizing to create a protective layer is not common, however, since a typical oxide layer forming at a titanium surface tends to be too thin to provide much protection. Rather, titanium and its alloys are often subjected to nitriding, carburizing, carbonitriding, nitro-carburizing, or similar processes in order to harden its surfaces to provide a protective surface finish, which can be extremely hard and ceramic in nature. These processes are also sometimes used for cosmetic purposes, since they can sometimes result in color changes. For example, the gold appearance of titanium nitride is often selected for cosmetic reasons. These processes can be limiting, however, and it is generally not common for a very hard nitrided or carburized titanium surface to be further treated in a cosmetic manner.

While metal surface finish processes are known to have worked well in the past, there can be room for improvement. Accordingly, there is a need for improved systems and methods that provide durable and aesthetically pleasing metallic surface finishes for consumer devices.

SUMMARY

Representative embodiments set forth herein include various structures, methods, and features thereof for the disclosed durable cosmetic metal surface finishes. In particular, the disclosed embodiments set forth systems and methods for providing abrasion resistant and cosmetically appealing variably colored surface finishes for titanium components.

According to various embodiments, the disclosed systems and methods can provide durable metal surface finishes in a cosmetically appealing manner. An exemplary method of providing a surface finish to a metal part can include at least: 1) diffusion hardening a surface of the metal part until it becomes a hardened surface layer, and 2) oxidizing the diffusion-hardened surface layer to create an oxide coating thereon. The diffusion-hardened surface layer might be a ceramic and can be harder than an internal region of the metal part, and the oxide coating can have a color that is different from the metal or surface layer, the color being unachievable only by diffusion hardening or only by oxidizing.

In various embodiments, the metal can be titanium or a titanium alloy. The diffusion hardening can include carburizing, nitriding, boriding, or any combination thereof. Oxidizing can include electrochemical oxidization, such as anodizing or micro arc oxidation. The oxide layer thickness can be controlled via the amount of voltage applied during oxidation, with the oxide coating color being a function of the thickness. A broader range of brighter colors can be realized for the final surface (oxide coating). An enhanced hardness depth profile can extend to a depth of at least 20 microns below the oxide coating to provide a more durable surface finish.

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described will become apparent from the following Detailed Description, Figures, and Claims.

Other aspects and advantages of the embodiments described herein will become apparent from the following detailed description taken in conjunction with the accompanying drawings which illustrate, by way of example, the principles of the described embodiments.

BRIEF DESCRIPTION OF THE DRAWINGS

The included drawings are for illustrative purposes and serve only to provide examples of possible structures and methods for the disclosed durable cosmetic metal surface finishes. These drawings in no way limit any changes in form and detail that may be made to the embodiments by one skilled in the art without departing from the spirit and scope of the embodiments. The embodiments will be readily understood by the following detailed description in conjunction with the accompanying drawings, wherein like reference numerals designate like structural elements.

DETAILED DESCRIPTION

Figure 1:
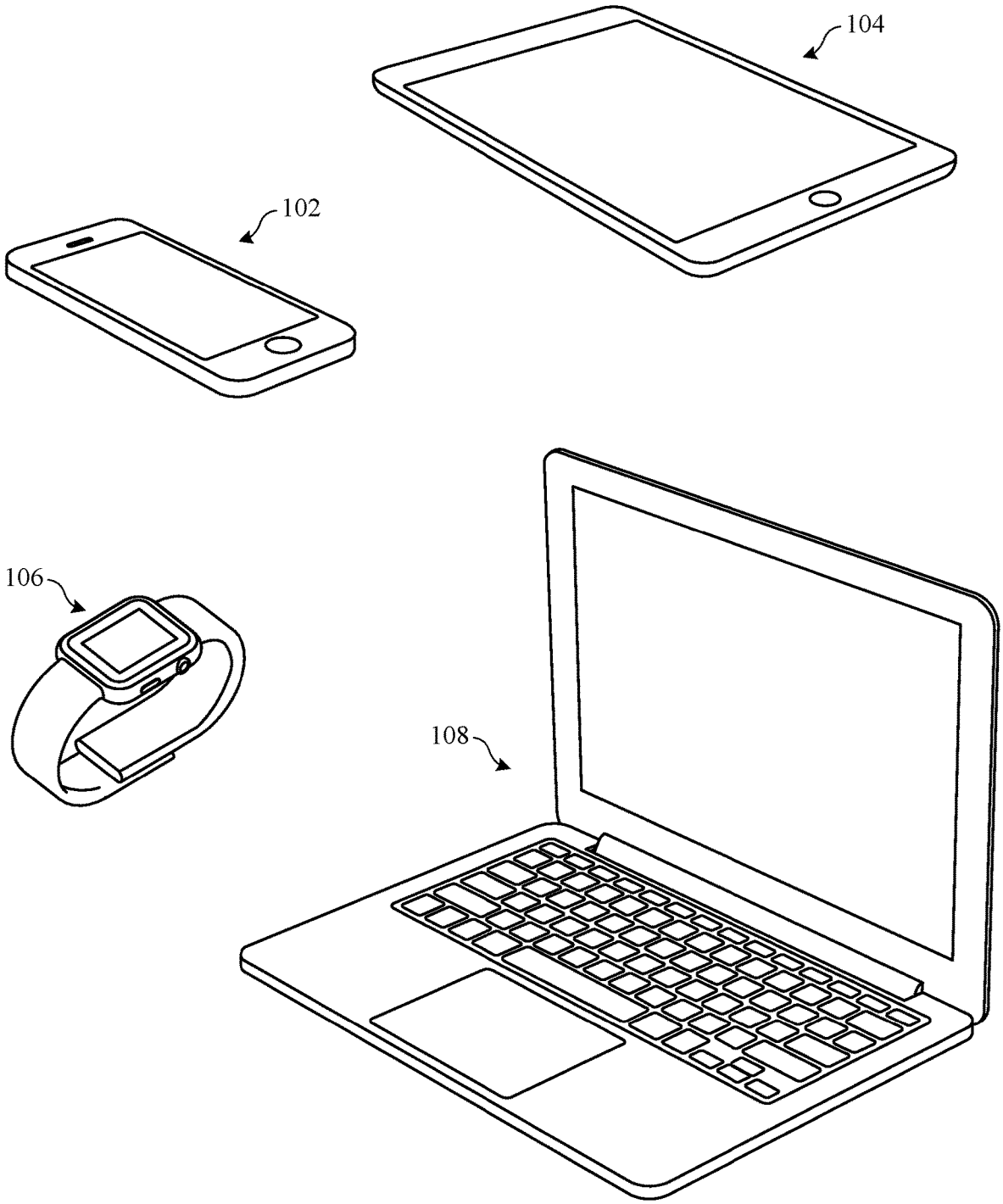
FIG. 1 illustrates in front perspective view various exemplary consumer devices having outer surfaces that can be protected using the abrasion resistant cosmetic metal surface finishes described herein.

Anodizing, oxidizing, nitriding, carburizing, and the like are all known ways of forming surface finishes on metal components, with different approaches and parameters being used depending upon the types of metal, cost considerations, other circumstances, and surface finishes desired. While various metal surface finish processes are known to have worked well in the past, there is often a need for improved methods for providing increasingly durable and aesthetically pleasing cosmetic metallic surface finishes, such as for consumer devices.

According to various embodiments, the disclosed systems and methods can provide abrasion resistant metal surface finishes in a cosmetically appealing manner. An exemplary method of providing a surface finish to a metal part can include diffusion hardening a metal surface of the metal part until it becomes a diffusion-hardened surface layer, and then oxidizing the diffusion-hardened surface layer to create a relatively thin oxide coating thereon. The diffusion-hardened surface layer might be a ceramic and can be harder than an internal region of the metal part, and the oxide coating can have a new color that is different from the original metal color or the ceramic or other diffusion-hardened layer color. This new color can be one that is not achievable only by diffusion hardening or only by oxidizing the original metal surface.

In some disclosed embodiments, benefits of nitriding or carburizing are combined with benefits of electrochemical oxidation techniques to form coatings of more varied and precisely controlled cosmetics, which also have improved durability against abrasive wear. In specific embodiments, surface treatments for titanium and its alloys provide both improved abrasion resistance, by increasing surface hardness, and control of surface color.

In various embodiments, the metal can be titanium or a titanium alloy. The diffusion hardening includes carburizing, nitriding, carbonitriding, nitrocarburizing, boriding, or any combination thereof. The diffusion-hardened surface layer can include titanium nitride and/or titanium carbide, and can have a Vickers hardness of greater than 2000. Importantly, the diffusion-hardened surface, which might be all or at least partially ceramic, can retain some amount of electrical conductivity, such that the oxidizing can include electrochemical oxidization, such as anodizing or micro arc oxidation. The oxide layer thickness can be controlled via the amount of voltage applied during oxidation, with the oxide coating color being a function of the thickness. A broader range of colors and brighter overall colors can be realized for the final surface finish atop the oxide coating. The oxide coating can provide a more durable surface finish than a surface finish formed only by the diffusion hardening or only by the oxidizing. Further, the oxide coating, diffusion-hardened surface layer, and internal region of the metal part can together define a hardness depth profile having a greater peak hardness than is achievable by oxidization alone, and an enhanced hardness to a depth of at least 20 microns below the top of the oxide coating.

In various further embodiments, a metal part can have a surface finish formed by a process comprising any of the foregoing methods involving diffusion hardening a metal surface to form a diffusion-hardened surface layer and then oxidizing the surface layer to create an oxide coating, as well as any combination of the various details thereof. Again, various new properties can be realized in metal parts formed by these processes, with such properties including different surface colors, different hardness depth profiles and augmented hardness extending to further depths, and more durable surface finishes. In still further embodiments, a metal part can be formed from a titanium or titanium alloy, with the metal part having an oxide coating formed atop a diffusion-hardened layer of titanium nitride or titanium carbide that is in turn formed atop an internal region of the metal part. The oxide coating, diffusion-hardened layer, and internal region of the metal part can define a depth profile of hardness that includes a peak hardness of over 2000 Vickers hardness at the top of the diffusion-hardened layer to over 450 Vickers hardness at a depth of at least 20 microns below the top of the oxide coating, and/or the oxide coating can have a color that is different than any color that is achievable for any metal part surface formed from pure titanium, titanium alloy, titanium nitride, titanium carbide, or titanium oxide.

The foregoing approaches provide various methods, components, and features for the disclosed abrasion resistant cosmetic metal surface finishes. A more detailed discussion of these methods, components, and features thereof is set forth below and described in conjunction with FIGS. 1-7, which illustrate detailed diagrams of devices and components that can be used to implement these methods, components, and features.

It will be understood that the various methods, components, and features disclosed herein may be applied for surface treatments on several different types of metals. For purposes of discussion, reference is specifically made to titanium or titanium alloys, which can include, for example, Ti6Al4V or "Titanium Grade 5" (hereinafter "Ti64"). Other alloy compositions and other metals may also be used in place of titanium or titanium alloys in various applications of the disclosed surface treatments and abrasion resistant cosmetic metal surface finishes, particularly alloys which are readily anodisable or oxidisable in a precisely controlled manner—even if only traditionally to the extent of forming thin-film oxides in the interference-coloring range of thickness (i.e., 100 s of nm). As some non-limiting examples, the disclosed surface treatments might also be applied to aluminum, magnesium, zirconium, niobium, tantalum, and/or alloys thereof, in addition to titanium, Ti64, or other titanium alloys. Even stainless steel, where thin-film oxides may be used to color the surface through temper-annealing, as yet another example, may be treated in the various ways set forth herein.

Turning first to FIG. 1, various exemplary consumer devices having outer surfaces that can be protected using the abrasion resistant cosmetic metal surface finishes described herein are illustrated in front perspective view. FIG. 1 includes portable phone 102, tablet computer 104, smart watch 106, and portable computer 108, each of which can include internal processing components within outer housings that can be made of metal or have metal sections. Various kinds of metal or metal alloys can be selected for such outer housings or sections thereof. Again, for purposes of discussion herein, reference will simply be made to titanium or titanium alloys, although other alloy compositions and other metals may also be used where suitable. During regular consumer use and wear, any ordinary titanium or titanium alloy portions of devices 102, 104, 106, and/or 108 can be subject to scratches, nicks, dents, and other surface defects that are not aesthetically pleasing. Such defects can cause physical and cosmetic discontinuities in the device surface, with cosmetic discontinuities also possibly affecting the surface color or colors in a negative manner at the defect region. As described in detail below, various methods, components, and features provide for more durable, abrasion resistant and cosmetically appealing surface finishes on devices such as devices 102, 104, 106 and 108, such that surface defects can be greatly minimized during regular consumer use and wear of these devices.

Figure 2A:
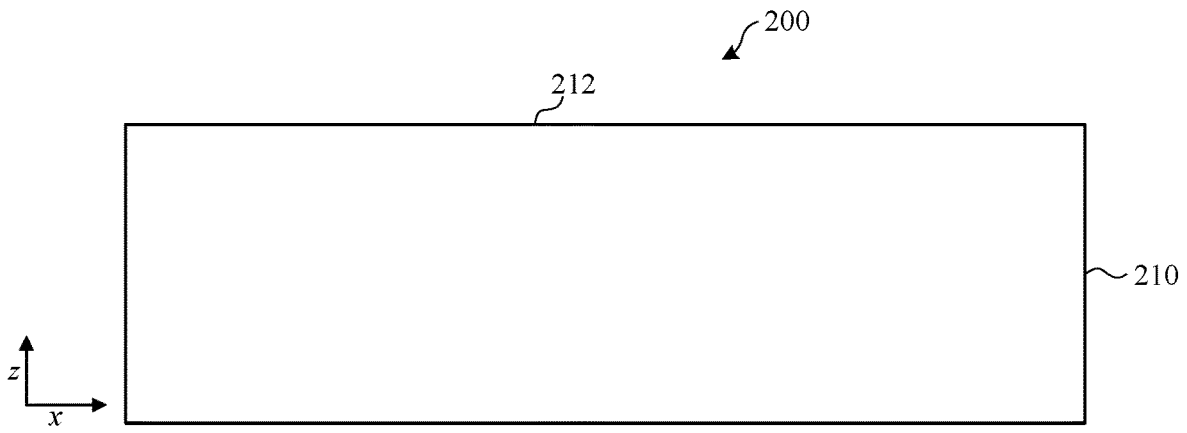
FIG. 2A illustrates in side cross-sectional view an exemplary metal part surface region with no surface treatment applied thereto according to various embodiments of the present disclosure.
Figure 2B:
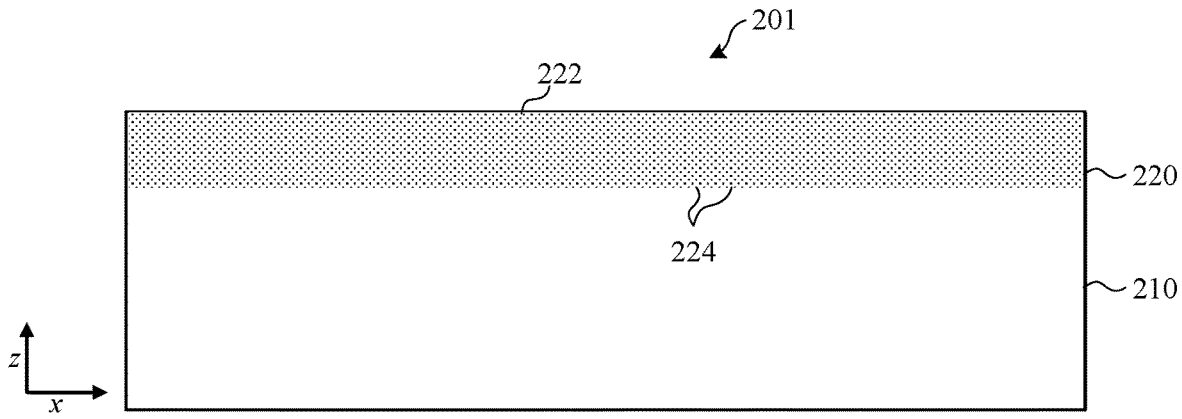
FIG. 2B illustrates in side cross-sectional view the exemplary metal part surface region of FIG. 2A after diffusion hardening the metal surface to form a hardened surface layer according to various embodiments of the present disclosure.
Figure 2C:
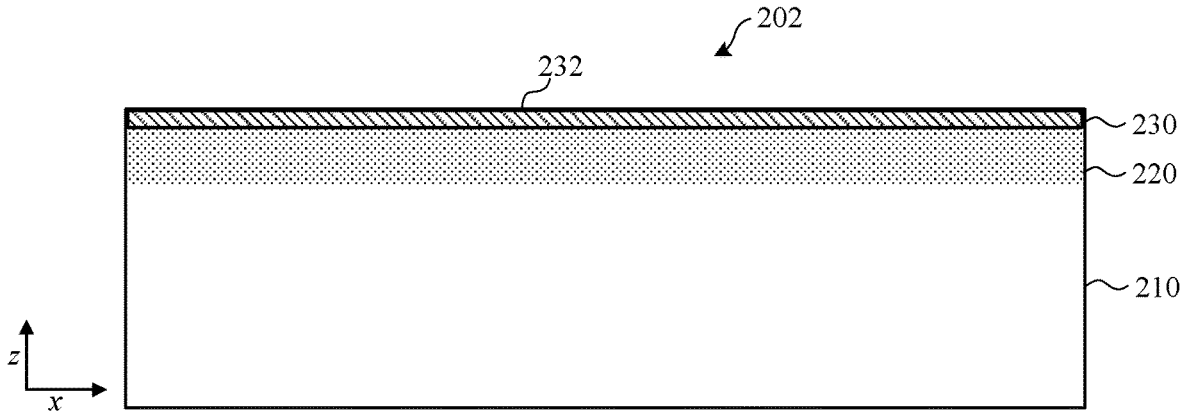
FIG. 2C illustrates in side cross-sectional view the exemplary metal part surface region of FIG. 2B after oxidizing the diffusion-hardened surface to create an oxide coating thereon according to various embodiments of the present disclosure.

FIGS. 2A-2C all depict in side cross-sectional view various stages of an exemplary metal part surface region as a surface finish is provided thereto. The metal part surface region and surface finish shown can be associated with any suitable metal part, such as a metal part used to form an outer housing or portion thereof for any of the foregoing consumer devices 102, 104, 106, 108, or the like. FIG. 2A illustrates a metal part surface region with no surface treatment process or step yet applied. Metal part surface region 200 can be a homogenous metal part having an exposed metal surface 212 at the maximum z-height, which metal surface 212 can have the same color and composition as the rest of the metal part. For example, the metal part can be formed from titanium, Ti64, or another suitable titanium alloy at all locations about the metal part and metal part surface region 200. For purposes of discussion, the metal part can be formed from solid Ti64, which material can have a hardness of about 290-350 HV, and which material is designated here as Ti64 region 210. A diffusion hardening process can then be applied to the exposed metal surface 212, which can be Ti64. This can include performing any carburizing, nitriding, carbonitriding, nitrocarburizing, or boriding process, or any combination thereof, to the exposed metal surface 212 of the Ti64 region 210 of the metal part. This may be achieved by such processes as gas nitriding or plasma nitriding, among others.

FIG. 2B illustrates a changed metal part surface region 201 after diffusion hardening the previous metal surface 212 of Ti64 enough to form a diffusion-hardened layer 220, which may include ceramic particles. As such, diffusion-hardened layer 220 might be all or at least partially ceramic in nature. Metal part surface region 201 can have a Ti64 region 210 situated beneath the diffusion-hardened layer 220, wherein ceramic or partially ceramic material may now form the exposed surface 222, which can have a color that is different than the color of Ti64. The diffusion-hardened layer 220 can compose a titanium nitride and/or titanium carbide material, for example, either of which can have a hardness of over 2000 HV, and which can result in a gold or bronze color at the exposed surface 222. Various titanium nitride and/or titanium carbide particles 224 can be diffused into the diffusion-hardened layer 220, with the concentration of these particles being higher toward the exposed surface 222 and sparser toward the Ti64 region 210 at an internal region of the metal part. In various embodiments, the diffusion hardening process can also result in the diffusion of simple nitrogen or carbon atoms into and about the diffusion-hardened layer 220 and the upper portions of the Ti64 region 210, providing strength and hardness through solution strengthening. Similarly, these diffused nitrogen and carbon atoms can be more heavily concentrated toward the exposed surface 222. An oxidizing process can then be applied to the exposed surface 222. This can be a thermal oxidizing process, such as the temper annealing of steel or stainless steel. Where the exposed surface 222 retains electrically conductive properties, for example because it remains metallic, with solution strengthening, or with precipitate strengthening, or is an intermetallic or semiconductor, the oxidation can be a controlled electrochemical oxidation, such as an anodization or micro arc oxidation process.

In various embodiments, the oxidation process can be a conventional titanium anodizing process where thin oxide films or coatings are grown by immersing the part in an electrolyte, such as phosphoric or sulfuric acid, and supplying electrical current under a positive potential. These thin oxide films or coatings can have a thickness on the order of tens of nanometers to several microns, and the thickness can be dependent on the applied voltage that is used for coating formation. For the thinner oxide films, the color of the film or coating also varies with its thickness due to optical interference between light reflected from the oxide film outer surface and the oxide/metal interface, as will be readily appreciated.

FIG. 2C illustrates the metal part surface region after oxidizing the diffusion-hardened surface to create a thin oxide coating thereon. Metal part surface region 202 can have a Ti64 region 210 situated beneath a diffusion-hardened layer 220, which in turn is situated beneath a thin oxide coating 230, which oxide material now forms the exposed oxide surface 232. The oxide coating 230 can have a hardness that is somewhat lower than the hardness of the diffusion-hardened layer 220 (e.g., over 2000 HV), but a hardness that is still higher than the hardness of the Ti64 region 210 (e.g., 290-350 HV) beneath that. The presence of oxide coating 230 again alters the color of the exposed oxide surface 232, the exact color, hue, and brightness of which can vary as a function of several factors, particularly with respect to the thickness of the oxide coating 230 and the amount of voltage used in the oxidation process.

In the absence of any prior nitriding or carburizing operation, the color of the oxide coating would be a certain function of coating thickness, progressively varying from gold to purple, to blue, to green, as set forth in FIG. 4A below. By performing a prior nitriding, carburizing or nitrocarburizing operation, however, the starting point for a progression of color is changed, as well as the course of the color. The end point may also be a brighter white or a darker gray, as set forth in FIG. 4B below. In general, oxide films formed by surface oxidation of regular titanium or Ti64 are typically an amorphous oxide when formed at lower voltages, and may comprise crystalline rutile at higher voltages. They do not significantly enhance the surface hardness of the article, and may be easily worn away by abrasive interactions, changing the appearance of the article. Oxide films formed by oxidation of previously nitrided, carburized or nitrocarburized parts, however, are of augmented hardness and wear resistance due to the incorporation of TiN, TiC or TiCN compounds. This makes the resulting cosmetic finish more durable. Furthermore, whereas a conventional surface oxide yields an abrupt transition to the intrinsic hardness of the titanium or Ti64 substrate, the disclosed process results in an additional hardness profile that confers still greater durability on the surface finish, with the augmented sub-oxide surface hardness providing increased resistance to deformation.

In some embodiments, a micro arc oxidation can be used to generate an oxide film. This surface treatment is generally conducted at higher potentials than conventional anodizing, and involves localized plasma discharges that help to convert the growing film or coating into crystalline phases, which also enables higher thicknesses to be formed. The oxide coating that result from a micro arc oxidation process is opaque and typically of a brown or gray color, which can be determined by the exact alloy composition. With its enhanced hardness and thicknesses of several microns to tens of microns, an oxide coating formed by a micro arc oxidation process can offer significantly enhanced surface protection in its own right. Again, however, the hardness due to this oxidation treatment is limited to the oxide layer itself. The underlying metal remains relatively soft and easily deformed. As a relatively brittle film, the oxide is thus susceptible to spallation when there is significant plastic deformation of the underlying metal, such as when the surface is subjected to impacts. Accordingly, the micro arc oxidation processes disclosed herein can be applied to previously nitrided, carburized, or nitrocarburized titanium articles, such that the metal substrate shows enhanced hardness to a greater depth. This offers both greater resistance to plastic deformation, and also protects the hard, brittle oxide coating from adhesive failures under certain applied stresses, such as sudden impacts and the like. The resulting surface finish is thus more mechanically robust than that of an article subjected to micro arc oxidation processing alone. Furthermore, the color of the resulting oxide film may also be adjusted to a wider spectrum of colors than is achievable by a micro arc oxidation process alone.

Figure 3:
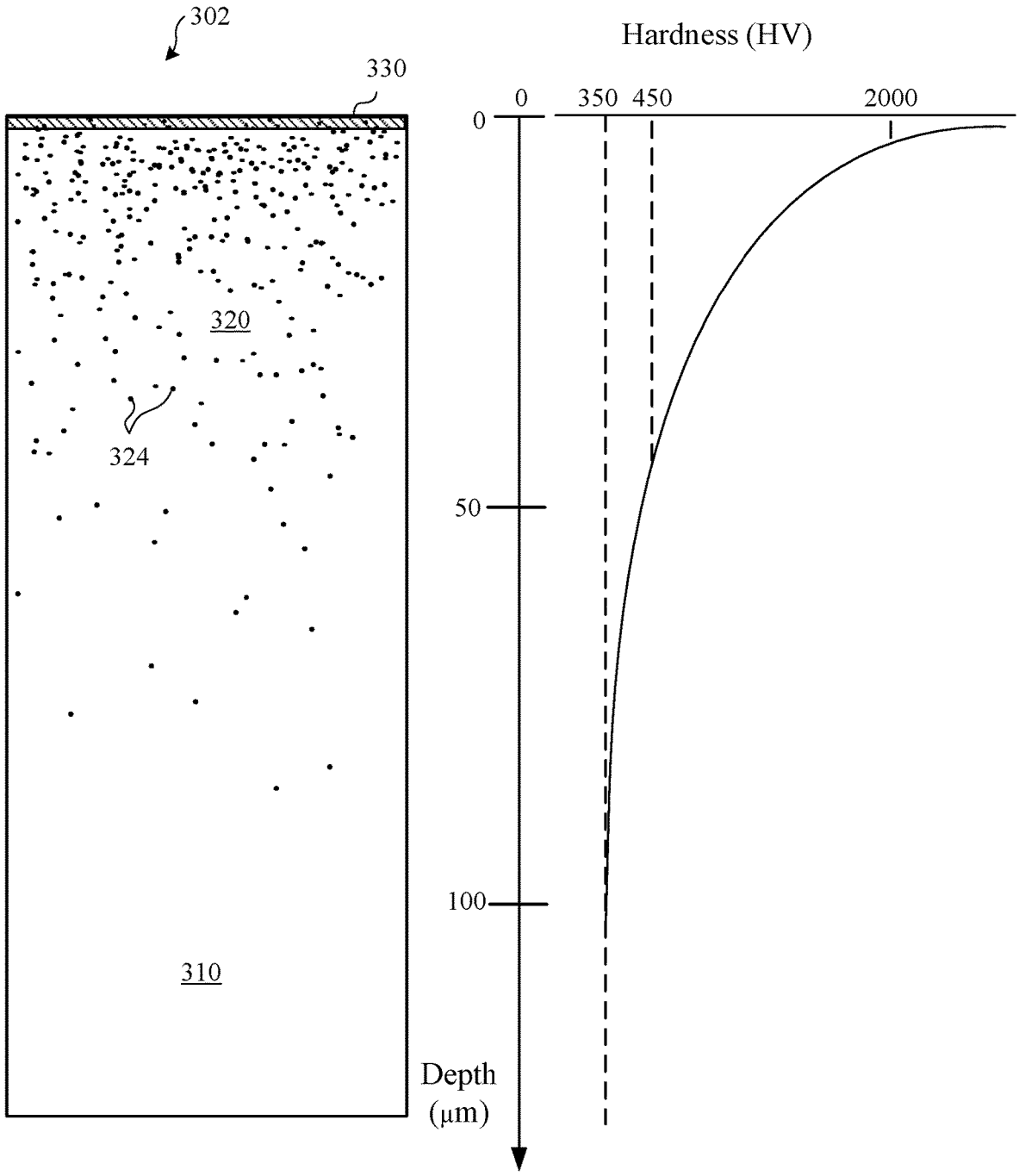
FIG. 3 illustrates in side cross-sectional view an alternative exemplary diffusion-hardened and oxidized metal part surface region having an enhanced hardness profile to a significant depth thereof according to various embodiments of the present disclosure.

Moving next to FIG. 3 an alternative exemplary diffusion hardened and oxidized metal part surface region having an enhanced hardness gradient to a significant depth is shown in side cross-sectional view. Metal part surface region 302 can be similar to metal part surface region 202 above, in that it can have a metal or metal alloy region 310, a hardened layer 320 with various hardening particles 324 diffused throughout, and an oxide coating 330 formed at the top surface of the surface region. The hardening particles 324 can be, for example, second phase ceramic particles, intermetallic particles, solution strengthening atoms, or any combination thereof. Again, the metal or metal alloy region 310 can be titanium or Ti64, the hardened layer 320 can include titanium nitride and/or titanium carbide, and the oxide coating 330 can have a significantly durable hardness and cosmetic finish including a color that is significantly different than the colors of the alloy region 310 or the hardened layer 320. Again, the exact color of the oxide coating 330 (and overall top surface) can be controlled by way of controlling the thickness of the oxide coating 330 and the amount of voltage used in the oxidizing process, among other possible parameters.

A representative plot of an exemplary enhanced hardness depth profile for a surface region treated in the manner provided herein is shown to the right of the metal part surface region 302. Because the formation of the hardened layer 320 can be accomplished using a diffusion process, the hardness of this layer, and the overall metal part surface region 302, can transition in a gradual manner from a maximum of over 2000 HV at the top of the hardened layer 320 to a minimum of about 290-350 HV for pure or solid Ti64 at the metal alloy region 310. Advantageously, the hardness can exceed 450 HV or more for a significant depth of the metal part surface region 302. As shown, this enhanced hardness gradient can extend to a depth of at least 20 microns below the surface, and up to about 50 microns or more below the surface in some cases.

The disclosed process provides an overall surface finish that is not only extremely hard at the actual surface, and thus scratch and abrasion resistant, but also a surface region that does not maintain this extreme hardness and corresponding brittleness to a considerable depth, which otherwise could result in a tendency to be brittle and chip or crack. In fact, the hardness of the overall metal part surface region 302 advantageously does not stay extremely hard or drop precipitously with depth, but rather only gradually tapers off to the 290-350 HV thickness of the inner pure metal or alloy. This provides a superior and durable surface finish compared to one that stays too hard and correspondingly brittle, or to one that quickly becomes too soft at a short depth beneath the surface. The disclosed surface processing including a combination of a diffusion hardening process followed by an oxidation process thus results in a more durable surface finish than a surface finish that would be formed only by the diffusion hardening process alone or only by the oxidizing process alone.

Figure 4A:
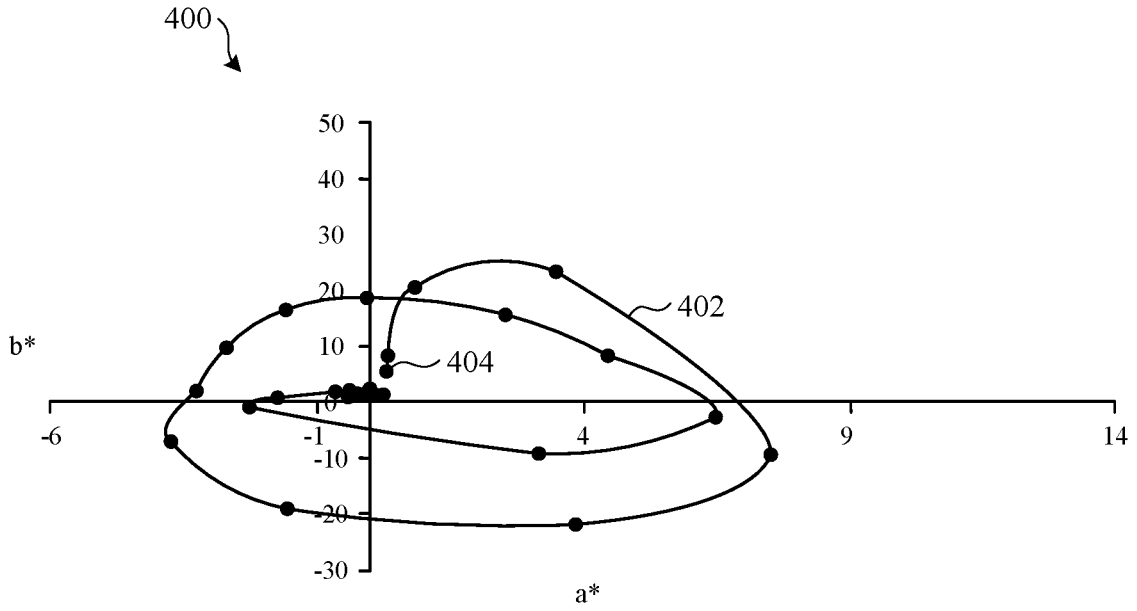
FIG. 4A illustrates a graph of an exemplary color progression experienced by a regular titanium alloy when anodized at increasing voltages according to various embodiments of the present disclosure.

FIG. 4A illustrates a graph of an exemplary color progression experienced by a regular titanium alloy when anodized at increasing voltages according to various embodiments of the present disclosure. Graph 400 provides a color progression (a*,b*) set along a typical yellow to red to blue to green clockwise pattern, which is plotted for a specific progression 402 that starts at a first point 404 for zero voltage. The metal is a regular previously untreated Ti64 sample, and the specifically plotted progression 402 ranges in voltage amounts from 0 to 200 for a repeated anodization of the regular Ti64 sample. As shown, the color progression is varied but rather contained for different voltages in oxidizing a regular Ti64 sample.

Figure 4B:
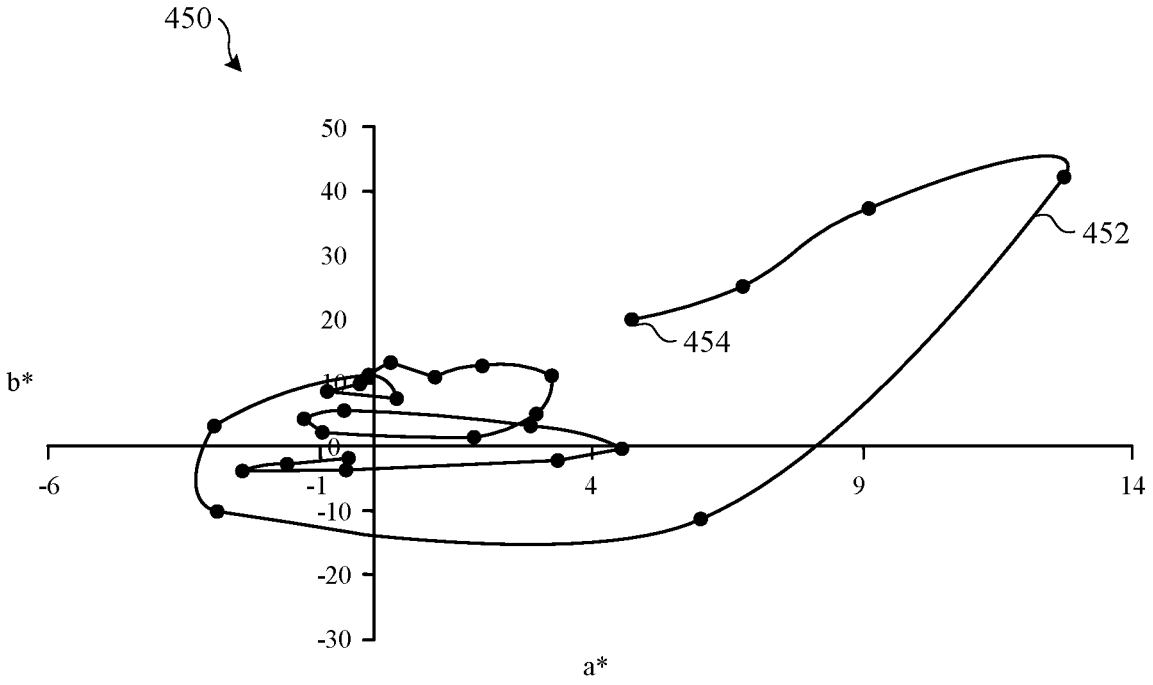
FIG. 4B illustrates a graph of an exemplary color progression experienced by a nitrided titanium alloy when anodized at increasing voltages according to various embodiments of the present disclosure.

FIG. 4B illustrates a graph of an exemplary color progression experienced by a nitrided titanium alloy when anodized at increasing voltages according to various embodiments of the present disclosure. Graph 450 provides a comparative color progression (a*,b*) set along the same yellow to red to blue to green clockwise pattern, which is plotted here for a specific progression 452 that starts at a first point 454 for zero voltage. Here, the metal is a previously nitrided Ti64 sample, and the specifically plotted progression 452 again ranges in voltage amounts from 0 to 200 for a repeated anodization of the nitrided Ti64 sample. As shown, different colors can be achieved by oxidizing a nitrided Ti64 sample than can be achieved by oxidizing a regular Ti64 sample. These colors tend more toward whites and greys, although other new colors and hues are also attainable. Similar effects can be seen in other similar metals after being subjected to a similar diffusion hardening process.

Figure 5A:
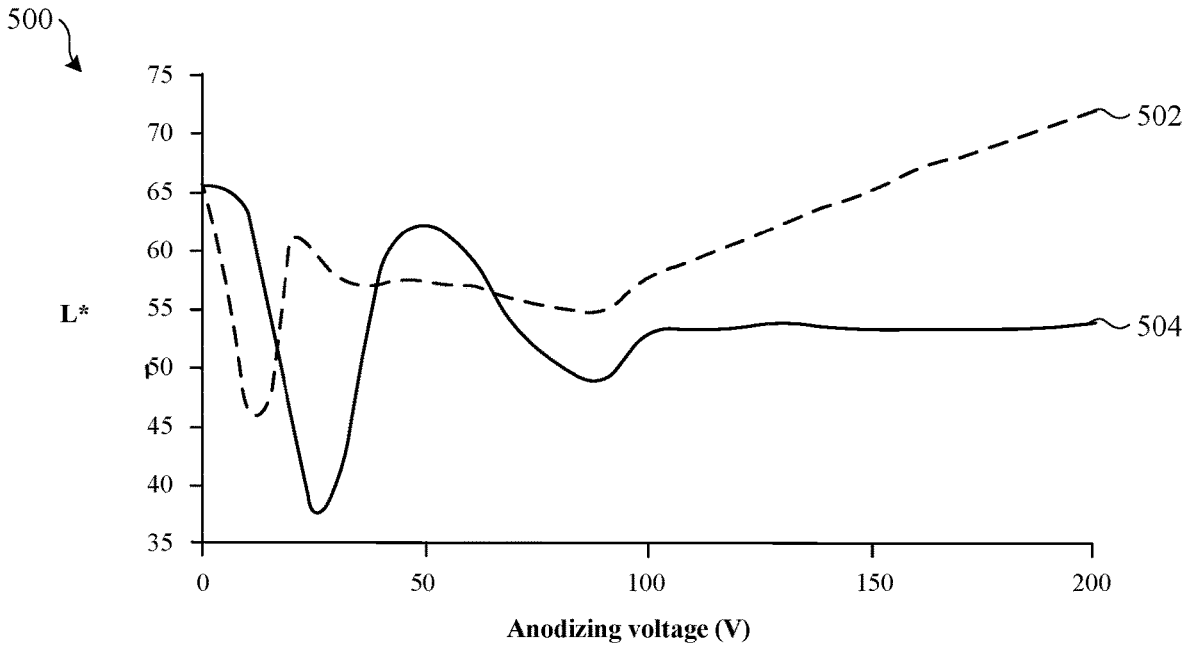
FIG. 5A illustrates a graph of exemplary lightness color-dimension functions experienced by regular and nitrided titanium alloys at different anodization voltages according to various embodiments of the present disclosure.

FIG. 5A illustrates a graph of exemplary lightness color-dimension functions experienced by regular and nitrided titanium alloys at different anodization voltages according to various embodiments of the present disclosure. Graph 500 depicts the differences exhibited by regular and nitrided Ni64 with respect to a lightness color-dimension L* (which ranges from dark at 0 to white at 100). Plotted progression 502 depicts the tendency toward increasing lightness L* in a previously nitrided Ni64 sample with increasing voltages, while plotted progression 504 depicts the tendency toward a plateauing lightness L* in a regular Ni64 sample with increasing voltages. Similar effects can be seen in other similar metals after being subjected to a similar diffusion hardening process.

Figure 5B:
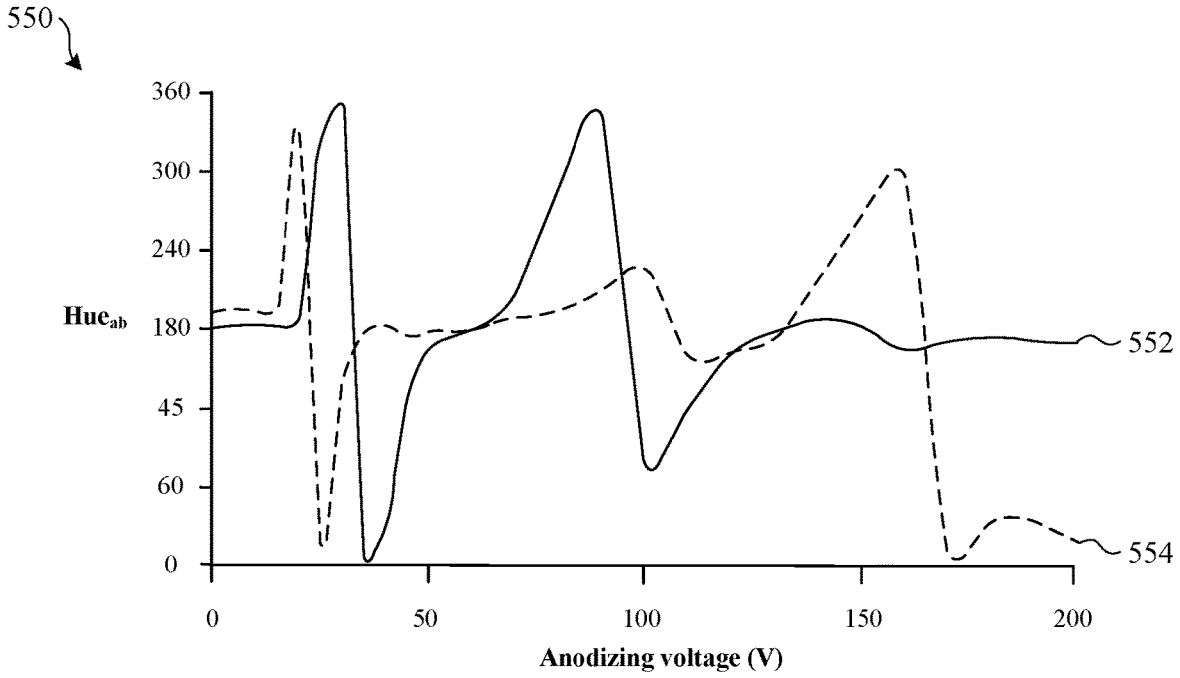
FIG. 5B illustrates a graph of exemplary hue color-dimension functions experienced by regular and nitrided titanium alloys at different anodization voltages according to various embodiments of the present disclosure.

FIG. 5B illustrates a graph of exemplary hue color-dimension functions experienced by regular and nitrided titanium alloys at different anodization voltages according to various embodiments of the present disclosure. Graph 550 depicts the tendency of a nitrided alloy to trail in hue behind a similar untreated alloy. Plotted progression 552 depicts a hue progression as a function of applied voltage for a regular Ni64 sample, while plotted progression 554 depicts a hue progression as a function of applied voltage for a previously nitrided Ni64 sample. Again, similar effects can be seen in other similar metals after being subjected to a similar diffusion hardening process.

Figure 6:
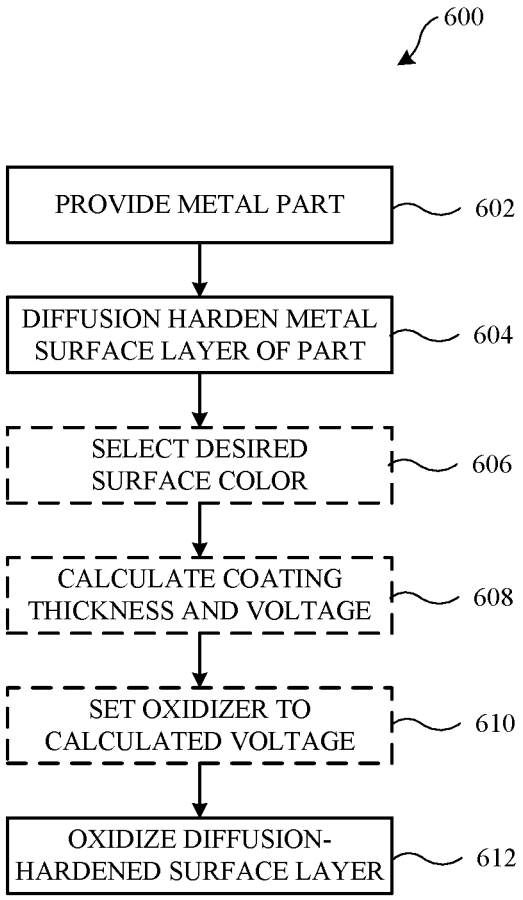
FIG. 6 illustrates a flowchart of an exemplary method for providing a surface finish to a metal part according to various embodiments of the present disclosure.

Turning next to FIG. 6, a flowchart of an exemplary method for providing a surface finish to a metal part is provided. Method 600 can be carried out by one or more processors or other controllers that may be associated with an automated surface finishing system, such as to control various automated processing components, for example. Method 600 starts at a first process step 602, where a metal part having a first color can be provided for providing the surface finish. Again, many different kinds of metals can be used, although it is specifically contemplated that the metal can be titanium or a titanium alloy. At a subsequent process step 604, a metal surface layer of the metal part can be diffusion hardened until the metal surface layer is harder than an internal region of the metal part. Again, the diffusion hardening can include carburizing, nitriding, carbonitriding, nitrocarburizing, boriding, or any combination thereof. Again, this may result in a hardened layer that is all or at least partially ceramic in nature.

At a following optional process step 606, a selection of a desired surface color can take place. As noted above, a wide variety of surface colors are possible when implementing the disclosed methods for providing a surface finish to a metal part. Where selection of a desired surface color is made, then a subsequent optional process step 608 can involve calculating a specific oxide coating thickness that will result in the selected color, upon which an oxidation voltage can also be calculated to result in the specific oxide coating thickness. An oxidizer can then be set to the calculated voltage at a following optional process step 610. At a final process step 612, the diffusion-hardened or otherwise hardened surface layer can be oxidized to create an oxide coating on the surface layer. As in the foregoing embodiments, this oxidizing step can involve an electrochemical oxidization, such as anodizing or micro arc oxidizing. Also, the oxide coating can have a second color that is different than the first color, and this second color can be a color that is unachievable only by the diffusion hardening step alone or only by the oxidizing step alone. Where the voltage has been set to a particular value, the second color should be one that has been selected prior to the oxidation process.

For the foregoing flowchart, it will be readily appreciated that not every step provided is always necessary, and that further steps not set forth herein may also be included. For example, added steps that involve designing specific colors or color patterns by way of differing oxidizing voltages may be added. Also, steps that provide more detail with respect to the exact type of diffusion hardening may also be added. Other steps not included may also involve steps and procedures to deal with the mass production of metal parts, such as for consumer devices. Furthermore, the exact order of steps may be altered as desired, and some steps may be performed simultaneously. For example, steps 608 and 610 may be performed simultaneously in some embodiments.

Figure 7:
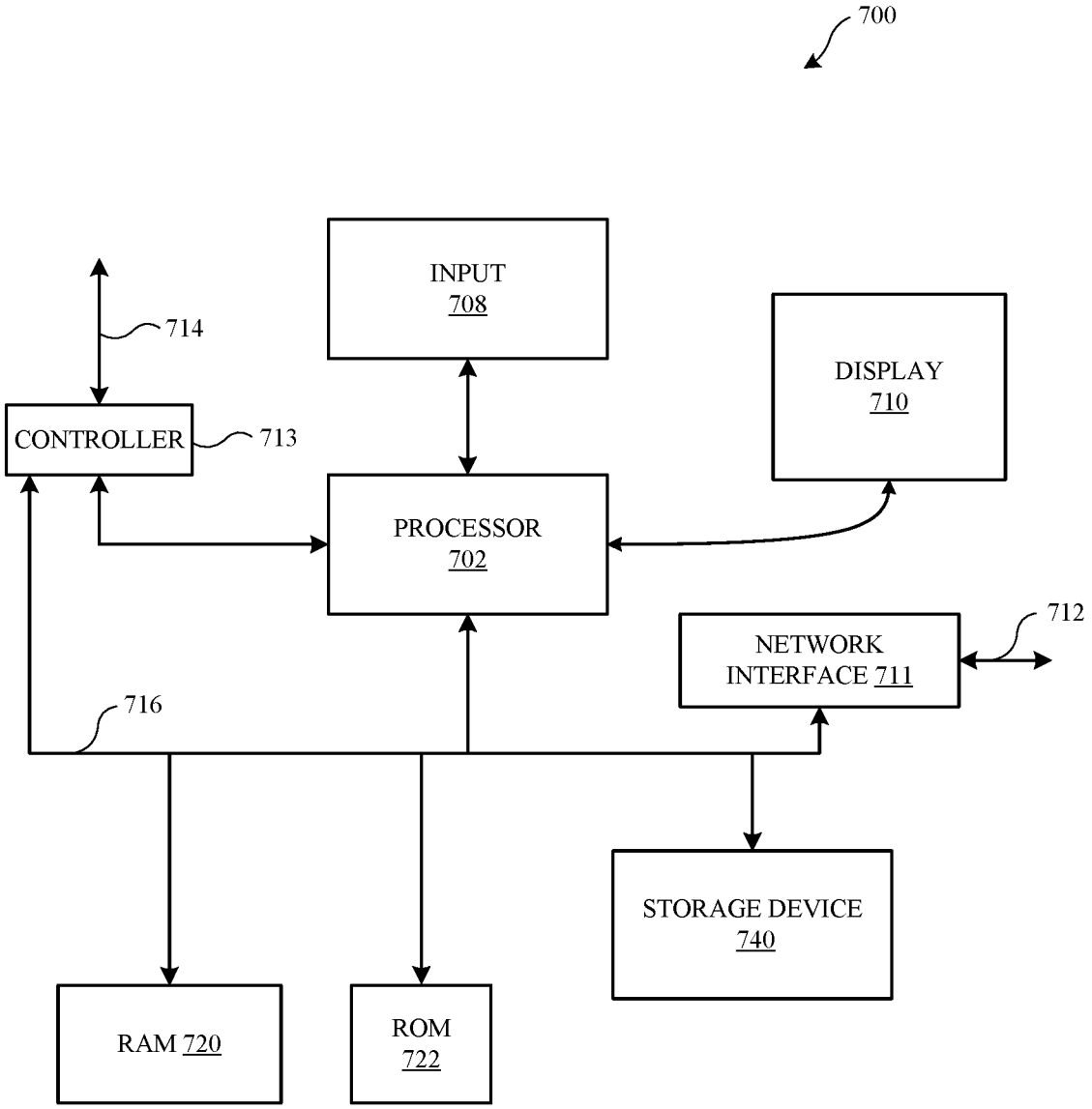
FIG. 7 illustrates in block diagram format an exemplary computing device that can be used to implement an automated metal surface finishing process such as that which is described herein according to various embodiments of the present disclosure.

FIG. 7 illustrates in block diagram format an exemplary computing device 700 that can be used to implement the various components and techniques described herein, according to some embodiments. In particular, the detailed view illustrates various components that can be included in an electronic device suitable for an automating the application of durable cosmetic surface finishes, such as that which is described above with respect to FIGS. 1-6. As shown in FIG. 7, the computing device 700 can include a processor 702 that represents a microprocessor or controller for controlling the overall operation of computing device 700. The computing device 700 can also include a user input device 708 that allows a user of the computing device 700 to interact with the computing device 700. For example, the user input device 708 can take a variety of forms, such as a button, keypad, dial, touch screen, audio input interface, visual/image capture input interface, input in the form of other sensor data, etc. Still further, the computing device 700 can include a display 710 (screen display) that can be controlled by the processor 702 to display information to the user (for example, a movie or other AV or media content). A data bus 716 can facilitate data transfer between at least a storage device 740, the processor 702, and a controller 713. The controller 713 can be used to interface with and control different equipment through and equipment control bus 714. The computing device 700 can also include a network/bus interface 711 that couples to a data link 712. In the case of a wireless connection, the network/bus interface 711 can include a wireless transceiver.

The computing device 700 can also include a storage device 740, which can comprise a single disk or a plurality of disks (e.g., hard drives), and includes a storage management module that manages one or more partitions within the storage device 740. In some embodiments, storage device 740 can include flash memory, semiconductor (solid state) memory or the like. The computing device 700 can also include a Random Access Memory (RAM) 720 and a Read-Only Memory (ROM) 722. The ROM 722 can store programs, utilities or processes to be executed in a non-volatile manner. The RAM 720 can provide volatile data storage, and stores instructions related to the operation of the computing device 700.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium. The computer readable medium is any data storage device that can store data which can thereafter be read by a computer system. Examples of the computer readable medium include read-only memory, random-access memory, CD-ROMs, DVDs, magnetic tape, hard disk drives, solid state drives, and optical data storage devices. The computer readable medium can also be distributed over network-coupled computer systems so that the computer readable code is stored and executed in a distributed fashion.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A metal part having a modified surface finish, the metal part comprising:

a metal substrate having a first color;

a diffusion-hardened surface layer that overlays the metal substrate; and a metal oxide coating that overlays the diffusion-hardened surface layer, the metal oxide coating having a specific thickness that is sufficient to impart the metal oxide coating with a second color that is different from the first color and different from any color attainable by only oxidizing the metal substrate without the diffusion-hardened surface layer, wherein the diffusion-hardened surface layer has a third color that is different from the first and second colors.

2. The metal part of claim 1, wherein the metal substrate includes titanium or an alloy thereof.

3. The metal part of claim 2, wherein the diffusion-hardened surface layer is formed via carburizing, nitriding, carbonitriding, nitrocarburizing, boriding, or any combination thereof.

4. The metal part of claim 3, wherein:

the metal oxide coating is formed by oxidation of the diffusion-hardened surface layer in an electrolyte that includes phosphoric acid or sulfuric acid, and the second color is correlated with a specific thickness of the metal oxide coating and a voltage applied during the oxidation.

5. The metal part of claim 1, wherein a hardness depth profile across the metal oxide coating, the diffusion-hardened surface layer, and at least a portion of the substrate ranges from over 2000 Vickers hardness to over 450 Vickers hardness at a depth of at least 20 microns below a top surface of the metal oxide coating.

6. The metal part of claim 1, wherein titanium nitride particles are diffused into the diffusion-hardened surface layer.

7. The metal part of claim 1, wherein titanium carbide particles are diffused into the diffusion-hardened surface layer.

8. A housing for an electronic device having a cosmetic finish applied thereon, the housing comprising:

a substrate of titanium or titanium alloy, wherein the substrate has a first color;

a diffusion-hardened surface layer that overlays the substrate; and an anodized layer that overlays the diffusion-hardened surface layer, the anodized layer having a thickness that is sufficient to impart the anodized layer with a second color that is different from the first color, wherein the second color cannot be achieved through only oxidation of the substrate.

9. The housing of claim 8, wherein the diffusion-hardened surface layer comprises a ceramic that includes particles of titanium carbide or titanium nitride diffused therein.

10. The housing of claim 9, wherein the anodized layer is formed by oxidation of the diffusion-hardened surface layer in an electrolyte that includes phosphoric acid or sulfuric acid.

11. The housing of claim 8, wherein the housing is characterized by a hardness of at least 450 Vickers to a depth of at least 20 microns below a top surface of the anodized layer.

12. The housing of claim 8, wherein the diffusion-hardened surface layer is characterized by a hardness of at least 2000 Vickers.

13. The housing of claim 8, wherein the second color is more white, as specified by an L* value, than a color achieved through only oxidation of the substrate.

14. An electronic device, comprising:

a housing comprising:

a metal substrate having a first color, a ceramic layer disposed on a surface of the metal substrate, and an oxide layer formed on the ceramic layer via an oxidation process, the oxide layer providing a cosmetic finish to the housing and having a second color correlated to a thickness of the oxide layer and a voltage applied during the oxidation process, wherein the second color is characterized by a larger L* value than is achievable through the oxidation process as applied to the metal substrate without the ceramic layer;

a processor disposed in the housing; and a display coupled to and controlled by the processor.

15. The electronic device of claim 14, wherein the ceramic layer includes particles of titanium carbide or titanium nitride diffused therein.

16. The electronic device of claim 14, wherein the metal substrate includes titanium or an alloy thereof.

17. The electronic device of claim 14, wherein the oxidation process comprises immersing the housing in an electrolyte subsequent to formation of the ceramic layer, the electrolyte comprising phosphoric or sulfuric acid, and applying the voltage across the housing and the electrolyte.

18. The electronic device of claim 14, wherein the housing is characterized by a hardness of at least 450 Vickers to a depth of 50 microns below a top surface of the oxide layer.

19. The electronic device of claim 14, wherein the electronic device comprises a portable phone, tablet computer, or wearable device.

20. A metal part having a modified surface finish, the metal part comprising:

a metal substrate having a first color;

a diffusion-hardened surface layer that overlays the metal substrate; and a metal oxide coating that overlays the diffusion-hardened surface layer, the metal oxide coating having a specific thickness that is sufficient to impart the metal oxide coating with a second color that is different from the first color, wherein titanium carbide particles are diffused into the diffusion-hardened surface layer.

* * * * *